US007627132B2

(12) United States Patent
Anderson

(10) Patent No.: US 7,627,132 B2
(45) Date of Patent: Dec. 1, 2009

(54) WIND NOISE REDUCTION FOR MICROPHONE

(75) Inventor: David Anderson, Sheffield (GB)

(73) Assignee: Sony Ericsson Mobile Communications AB, Lund (SE)

( * ) Notice: Subject to any disclaimer, the term of this patent is extended or adjusted under 35 U.S.C. 154(b) by 486 days.

(21) Appl. No.: 10/559,509

(22) PCT Filed: May 25, 2004

(86) PCT No.: PCT/EP2004/005605

§ 371 (c)(1),
(2), (4) Date: Dec. 5, 2005

(87) PCT Pub. No.: WO2004/112424

PCT Pub. Date: Dec. 23, 2004

(65) Prior Publication Data

US 2007/0003090 A1 Jan. 4, 2007

Related U.S. Application Data

(60) Provisional application No. 60/537,841, filed on Jan. 21, 2004.

(30) Foreign Application Priority Data

Jun. 6, 2003 (EP) ..... 03076938
Jan. 14, 2004 (EP) ..... 04000594

(51) Int. Cl.
*H04R 1/02* (2006.01)
*H04R 1/32* (2006.01)

(52) U.S. Cl. ..... 381/356; 381/359; 381/360; 381/365

(58) Field of Classification Search ..... 381/359, 381/360, 189, 356, 362, 365; 181/242
See application file for complete search history.

(56) References Cited

U.S. PATENT DOCUMENTS 2,536,261 A 1/1951 Caldwell, Jr.
2,552,878 A * 5/1951 Wiggins ..... 381/173
4,600,077 A * 7/1986 Drever ..... 181/242
4,789,044 A * 12/1988 Akino ..... 181/242
4,862,507 A * 8/1989 Woodard ..... 381/358
4,887,693 A * 12/1989 Plice ..... 181/242
4,966,252 A 10/1990 Drever (Continued)

FOREIGN PATENT DOCUMENTS

CN 1085378 A 4/1994

OTHER PUBLICATIONS

International Search Report: PCT/EP2004/005605.

(Continued)

*Primary Examiner*—Huyen D Le
*Assistant Examiner*—Jesse A Elbin
(74) *Attorney, Agent, or Firm*—Myers Bigel Sibley & Sajovec, P.A.

(57) ABSTRACT

The present invention relates to wind noise reduction for a microphone (10) achieved by locating a microphone pick up (2) in a chamber (4) provided with at least one sound passage (5), wherein one or more elements (s) (6) is/are provided in the sound passage (s) (5) to decrease the speed of the air stream.

16 Claims, 2 Drawing Sheets

U.S. PATENT DOCUMENTS 5,349,480 A * 9/1994 Takao ..... 360/74.1
5,442,713 A 8/1995 Patel et al.
5,444,790 A * 8/1995 Kogen ..... 381/359
6,470,176 B1 * 10/2002 Mendolia et al. ..... 455/90.1

OTHER PUBLICATIONS

First Office Action for Chinese Patent Application No. 200480015793 dated Jul. 3, 2009, 12 pages.

* cited by examiner

WIND NOISE REDUCTION FOR MICROPHONE

RELATED APPLICATIONS

The present application is a 35 U.S.C. 371 national phase application of PCT International Application No. PCT/EP2004/005605, having an international filing date of May 25, 2004 and claiming priority to European Patent Application No. 03076938.4, filed Jun. 6, 2003, to European Patent Application No. 04000594.4, filed Jan. 14, 2004, and to U.S. Provisional Application No. 60/537,841 filed Jan. 21, 2004, the disclosures of which are incorporated herein by reference in their entireties. The above PCT International Application was published in the English language and has International Publication No. WO 2004/112424 A1.

BACKGROUND OF THE INVENTION

The present invention relates to a transmitter portion of a portable electronic communication device and is concerned with reducing wind-noise produced by an undesired air stream blowing into a microphone.

Conventionally, several types of so-called "non-directional microphones" have been used in transmitters provided in portable electronic communication devices such as cellular phones. However, although these microphones are considered to be less sensitive to wind-noise from air blowing into the microphone compared to so-called "directional microphones", wind-noise is often still a problem. Therefore, noise cancelling algorithms are sometimes used to reduce this problem. However, a drawback is that due to power consumption, noise cancelling algorithms are not always suitable in portable electronic devices having limited battery capacity.

Moreover, non-directional microphones also suffer from low signal to ambient ratio, whereby noise or background sound can negatively influence voice. Therefore, there is also a need to improve this, for instance by using a directional microphone, which has a better signal to ambient ratio compared to a non-directional microphone. However, since a directional microphone is sensitive to wind noise, to be able to use the advantage compared to a non-directional microphone, wind noise sensitivity needs to be reduced. Due to large power consumption noise cancelling algorithms are not suitable in portable devices as described above. Because of that, non-directional microphones have not found wide-spread application among portable electronic devices of today.

Thus, there is a need of a microphone, in particular a directional microphone, for a portable electronic device having low power consumption, good signal to ambient ratio, and being resistant to wind noise.

SUMMARY OF THE INVENTION

The present invention is thus directed towards providing a microphone unit, in particular a directional microphone unit, for a portable electronic device that has low power consumption, good signal to ambient ratio, which device is resistant to wind noise.

Accordingly, an object of the invention is to provide a microphone for a telephone-transmitter to reduce wind-noise.

According to a first aspect of the invention, this is achieved by locating a microphone in a chamber provided with at least one sound passage, wherein one or more element(s) is/are provided in the sound passage(s) to decrease the speed of the air stream.

A microphone unit according to the invention includes, in front of a microphone pick up of the microphone unit a chamber. The chamber has a predetermined sectional area and volume, which together with the total sectional area and volume of the sound passages, reduces the influence of the undesired air stream.

A second aspect of the present invention is directed to a microphone unit for a portable electronic device, comprising a microphone pick up located within a microphone pick up housing forming a chamber. The chamber being provided with at least one sound passage opening for receiving sound from outside the device, wherein said at least one sound passage opening is provided with at least one wind noise reduction element.

A third aspect of the present invention is directed to a microphone unit including the aspects of the second aspect, wherein said wind reduction element comprises a mesh having one layer.

A fourth aspect of the present invention is directed to a microphone unit including the aspects of the second aspect, wherein said wind noise reduction element comprises a mesh having a plurality of layers.

A fifth aspect of the present invention is directed to a microphone unit including the aspects of the third or the fourth aspect, wherein the ratio between the chamber size and the density of the mesh is arranged to maintain the directional pick up pattern of the microphone used.

A sixth aspect of the present invention is directed to a microphone unit including the aspects of the second to the fifth aspect, wherein the mesh is made of metal.

A seventh aspect of the present invention is directed to a microphone unit including the aspects of the second to the sixth aspect, wherein the mesh is made of polymer material such as nylon.

An eighth aspect of the present invention is directed to a microphone unit including the aspects of the second to the seventh aspect, wherein said housing extending in a longitudinal direction is a cylinder having a jacket surface and a side surface.

A ninth aspect of the present invention is directed to a microphone unit including the aspects of the eight aspect, wherein said sound passage opening is a hole extending in the longitudinal direction in said mantle surface.

A tenth aspect of the present invention is directed to a microphone unit including the aspects of the eight or ninth aspect, wherein said hole is a hole in said side surface.

An eleventh aspect of the present invention is directed to a microphone unit including any one of the first to the tenth aspect, wherein said microphone unit is a directional microphone.

A twelfth aspect of the present invention is directed to a microphone unit according to any one of the first to the tenth aspects, wherein said microphone unit is non-directional.

These and other objects and advantages of the invention will be apparent from the following description taken in conjunction with the accompanying drawings.

DESCRIPTION OF THE PREFERRED EMBODIMENTS

The present invention can be advantageously applied to all types of microphones to reduce sensitivity to wind-noise. Wind-noise is a significant problem particularly in directional microphones, which are more sensitive to this disturbance. Accordingly, the invention will be described with reference to a preferred embodiment in which an electret condenser type directional microphone is used, but is not in any sense limited thereto.

Figure 1:
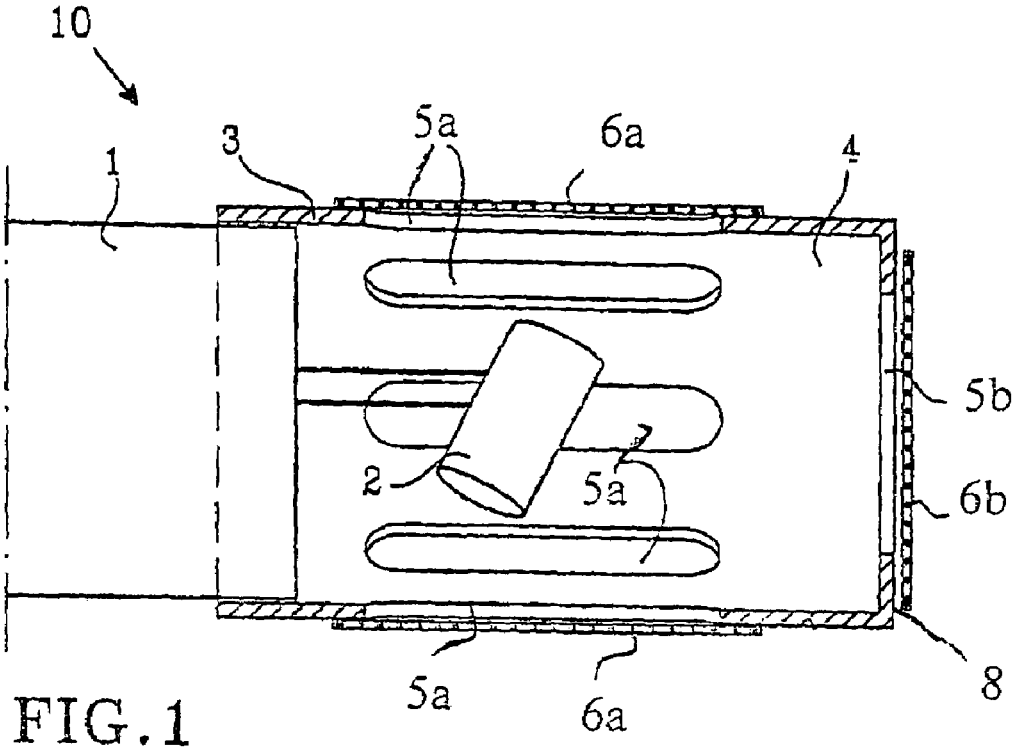
FIG. 1 is a schematic sectional view, of one embodiment of the microphone unit of the invention.

In FIG. 1 a main part 1 of a cellular phone transmitter unit is provided with a directional microphone pick up 2. The microphone pick up 2 is surrounded by a pick up housing 3 forming a chamber 4 having a predetermined cross-sectional area and a predetermined volume, which chamber 4 encloses the microphone pick up 2. The chamber 4 includes at least one sound passage opening 5, preferably a plurality of sound passage openings 5', 5", 5''', each opening 5', 5", 5''' provided with a wind noise reduction element 6. The number of wind noise reduction elements 6', 6", 6''' can be any suitable number and is by no means limited to a particular number. The microphone pick up 2, the housing 3, the sound passage openings 5', 5", 5''' and the noise reduction element 6', 6", 6" all together provide a directional microphone unit 10, which can be positioned in connection to a mouthpiece (not shown) provided in a front panel (not shown) of a portable electronic device (not shown). This is not shown in more detail since it is well known for a person skilled in the art of portable electronic devices.

Figure 2:
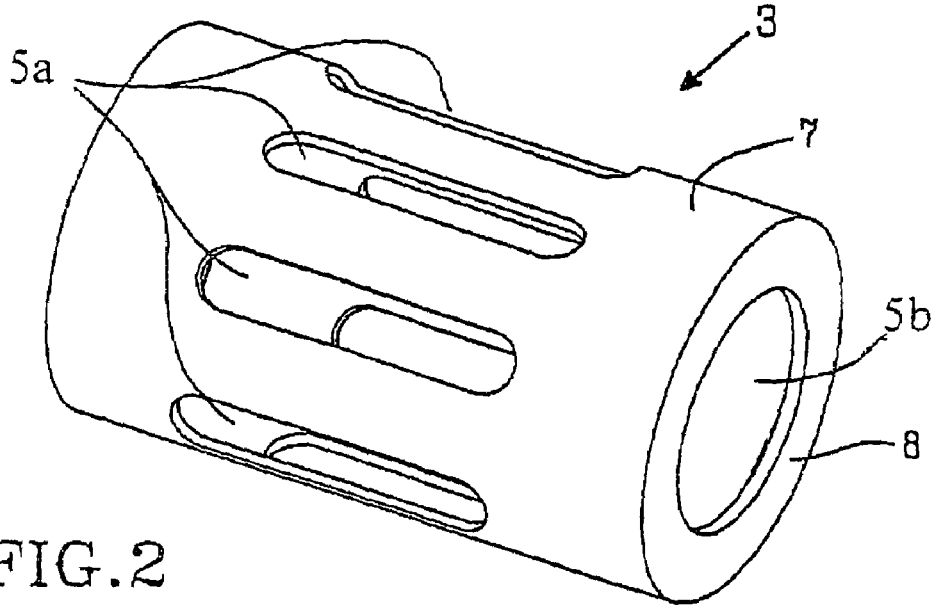
FIG. 2 is a perspective view, of an embodiment of the microphone unit of the invention.

Now is referred also to FIG. 2. Preferably, the housing 3 has the shape of a cylinder, provided with a number of relatively large sound passage openings (holes) arranged in all directions, for instance extending in a longitudinally direction of a jacket surface 7. Preferably, there is also provided a sound passage 5 opening in a side surface 8.

In a microphone unit 10 according to the invention, part of the air stream which includes wind-noise is interrupted or blocked by the mouthpiece (not shown), and part is able to pass through the sound passage openings 5, 5', 5" to enter the chamber 4. Because of the interaction between chamber 4 volume, openings 5, 5', 5" and wind noise reduction element 6, the air particle velocity, forming the wind, is not easily able to enter the chamber and produce wind-noise in the microphone pick up unit.

Figure 3:
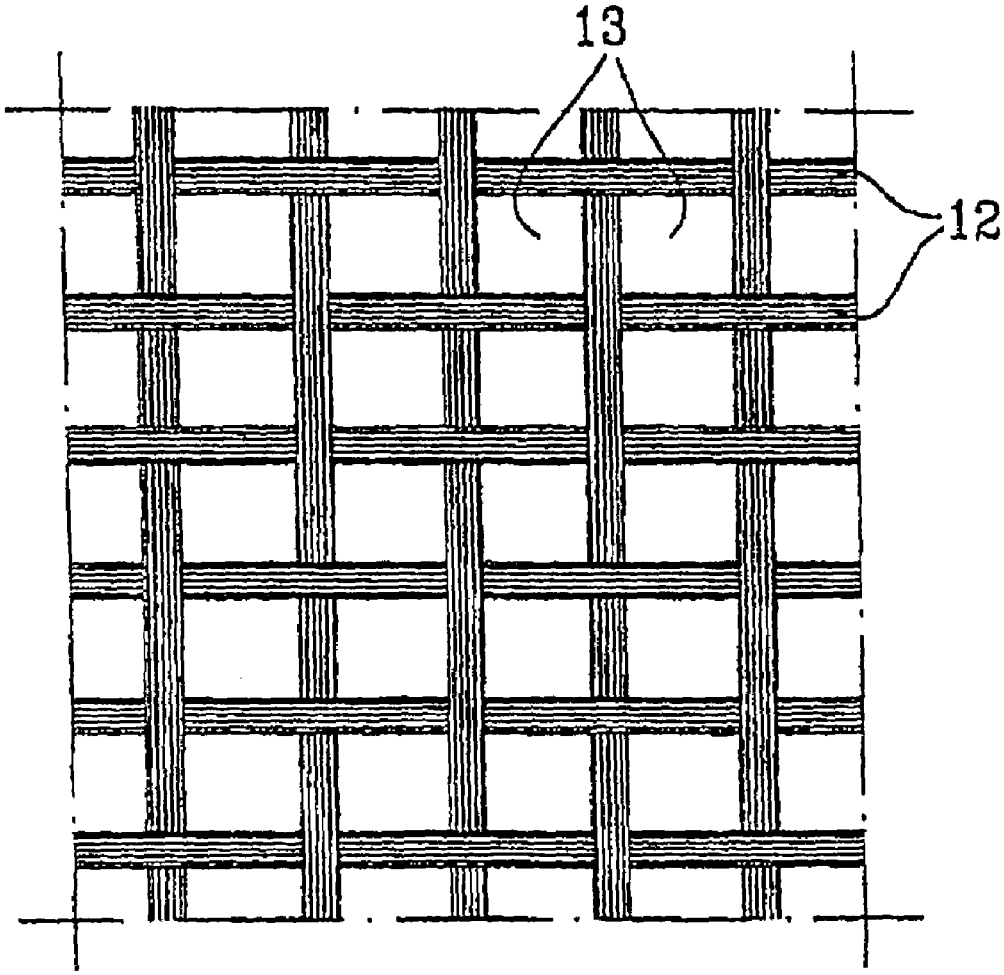
FIG. 3 is a schematic view of a mesh which was used to reduce wind-noise.

Now is referred to FIG. 3. The wind noise reduction element 6 could for instance comprise one single layer such as a mesh made of metal, or polymer material. The mesh can be of conventional type comprising wires 12 with openings 13. The mesh can also be made of textile fabrics such as cotton fabric or the like.

Typically, the ratio between the chamber size and the density of the mesh is arranged to maintain a desired level of directionality from the microphone pick up unit. Similarly the cross-sectional area and volume of the chamber may be determined experimentally to achieve the desired reduction in wind-noise.

Because the sensitivity of a microphone with respect to an air stream has, in general, a proportional relationship with the speed of the impinging air stream, it has been found that by decreasing the speed of the air stream as just described, wind-noise due to the air stream can be reduced to an almost negligible level. However, it has been found that the sound or speaking voice signal or sound wave is transmitted in a normal manner so that the reproduced speaking voice is not adversely affected.

Accordingly, it is seen that the inventive microphone unit provides greatly reduced sensitivity to wind-noise, is non-expensive, since no electronics or software is required, and offer good overall frequency response characteristics. The microphone unit is small in size, typically two to three times the size of the miniature microphone capsule. The reduction can vary from 15-30 dB depending on the amount of directionality that must be maintained. More reduction implies less directionality.

Although the invention has been described with reference to particular preferred embodiments, it is to be understood by those skilled in the art that various changes and modifications can be made without departing from the spirit and scope of the invention.

The invention claimed is:

1. A microphone for a mobile electronic device, the microphone comprising:

a microphone pick up housing having a cylindrical shielding surface defining a cylindrical chamber therein wherein the cylindrical shielding surface has at least three elongated holes therethrough, wherein a length of each of the elongated holes in a longitudinal direction of the cylindrical chamber is greater than a width thereof in a direction orthogonal with respect to the longitudinal direction wherein the at least three elongated holes are aligned in the longitudinal direction;

a microphone pick up located in the cylindrical chamber defined by the microphone pick up housing wherein the microphone pick up is surrounded by the at least three elongated holes; and a noise reduction element covering the elongated holes, wherein the microphone pick up comprises a directional condenser type microphone pick up that is surrounded by the at least three elongated holes, and wherein the directional condenser type microphone pick up is canted at an angle relative to the longitudinal direction of the cylindrical chamber.

2. A microphone according to claim 1 wherein the microphone pick up housing has an end surface that is perpendicular with respect to the longitudinal direction and wherein the end surface has an end sound passage opening therethrough.

3. A microphone according to claim 2 further comprising:

a second noise reduction element covering the end sound passage opening therethrough.

4. A microphone according to claim 1 wherein the noise reduction element comprises a noise reduction element on each of the at least three elongated holes.

5. A microphone according to claim 1 wherein the noise reduction element comprises a mesh.

6. A microphone according to claim 5 wherein the mesh comprises a metal mesh.

7. A microphone according to claim 5 wherein the mesh comprises a nylon mesh.

8. A microphone according to claim 1 wherein the noise reduction element comprises a mesh having a plurality of layers.

9. A cellular phone comprising a front panel;

a mouthpiece provided in the front panel; and a directional microphone unit adjacent the mouthpiece, wherein the directional microphone unit comprises, a microphone pick up housing having a cylindrical shielding surface defining cylindrical chamber therein wherein the cylindrical shielding surface has at least three elongated holes therethrough, wherein a length of each of the elongated holes in a longitudinal direction of the cylindrical chamber is greater than a width thereof in a direction orthogonal with respect to the longitudinal direction wherein the at least three elongated holes are aligned in the longitudinal direction;

a directional condenser type microphone pick up located in the cylindrical chamber defined by the microphone pick up housing wherein the microphone pick up is surrounded by the at least three elongated holes; and a noise reduction element covering the elongated holes;

wherein the directional condenser type microphone pick up is surrounded by the at least three elongated holes, and wherein the directional condenser type microphone pick up is canted at an angle relative to the longitudinal direction of the cylindrical chamber.

10. A cellular phone according to claim 9 wherein the microphone pick up housing has an end surface that is perpendicular with respect to the longitudinal direction and wherein the end surface has an end sound passage opening therethrough.

11. A cellular phone according to claim 10 further comprising:

a second noise reduction element covering the end sound passage opening therethrough.

12. A cellular phone according to claim 9 wherein the noise reduction element comprises a noise reduction element on each of the at least three elongated holes.

13. A cellular phone according to claim 9 wherein the noise reduction element comprises a mesh.

14. A cellular phone according to claim 13 wherein the mesh comprises a metal mesh.

15. A cellular phone according to claim 13 wherein the mesh comprises a nylon mesh.

16. A cellular phone according to claim 9 wherein the noise reduction element comprises a mesh having a plurality of layers.

* * * * *

UNITED STATES PATENT AND TRADEMARK OFFICE

CERTIFICATE OF CORRECTION

PATENT NO. : 7,627,132 B2
APPLICATION NO. : 10/559509
DATED : December 1, 2009
INVENTOR(S) : Anderson It is certified that error appears in the above-identified patent and that said Letters Patent is hereby corrected as shown below:

On Title Page:
Item 30, Foreign Application Priority Data:
Please correct "(EP) 03076938"
To read --(EP) 03076936--

Column 1, Line 10: Please correct "No. 03076938.4"
To read --No. 03076936.4--

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,627,132 B2
APPLICATION NO. : 10/559509
DATED : December 1, 2009
INVENTOR(S) : David Anderson It is certified that error appears in the above-identified patent and that said Letters Patent is hereby corrected as shown below:

This certificate supersedes the Certificate of Correction issued March 16, 2010. The certificate is vacated since request was based on incorrect information taken from the PCT for this patent. The Certificate of Correction should not have been issued.

Signed and Sealed this
Seventeenth Day of April, 2012

David J. Kappos

David J. Kappos
*Director of the United States Patent and Trademark Office*